United States Patent [19]

Giannelli

[11] Patent Number: 4,896,396

[45] Date of Patent: Jan. 30, 1990

[54] ELECTRICAL HOUSEHOLD APPLIANCE FOR STEAM CLEANING

[75] Inventor: Giuseppe Giannelli, Olgiate Comasco, Italy

[73] Assignee: MICROMAX S.p.A., Como, Italy

[21] Appl. No.: 262,490

[22] Filed: Oct. 25, 1988

[30] Foreign Application Priority Data

Nov. 16, 1987 [IT] Italy ..... 22649 A/87

[51] Int. Cl.[4] ..... A47L 7/00

[52] U.S. Cl. ..... 15/321; 15/353; 68/222; 138/111

[58] Field of Search ..... 15/321, 353, 322; 138/111, 115; 68/222

[56] References Cited

U.S. PATENT DOCUMENTS

| | | | |
|---|---|---|---|
| 2,497,435 | 2/1950 | Branneman | 15/321 X |
| 2,844,840 | 7/1958 | Gray | 15/321 |
| 2,971,538 | 2/1961 | Brumbach | 138/111 |
| 3,262,146 | 7/1966 | Hays | 15/321 |
| 3,559,427 | 2/1971 | Baker | 68/222 |
| 3,581,529 | 6/1971 | Mitchell et al. | 68/222 |
| 3,591,889 | 7/1971 | Wisner | 15/321 |
| 4,327,459 | 5/1982 | Gilbert | 15/321 |
| 4,517,404 | 5/1985 | Hughes et al. | 138/111 X |

*Primary Examiner*—Chris K. Moore

*Attorney, Agent, or Firm*—Davis Hoxie Faithfull & Hapgood

[57] ABSTRACT

An electrical household appliance for steam cleaning comprises, within a monocoque body, a steam generator having a boiler and a steam delivery conduit extending from the boiler, a suction device arranged to draw fluids including an electrical aspirator, a container for collecting the matter drawn, and a hose assembly including a suction conduit and a sleeve in the wall of the conduit containing the steam delivery conduit.

9 Claims, 3 Drawing Sheets

ELECTRICAL HOUSEHOLD APPLIANCE FOR STEAM CLEANING

DESCRIPTION

This invention relates to an electrical household appliance for steam cleaning applications.

The effectiveness of steam to clean and degrease surfaces is well known. In addition to removing dirt thoroughly from surfaces, steam also has an appreciable sanitizing and bacterial effect.

In view of the foregoing, small steam generators for household use are enjoying ever-increasing acceptance by the market.

Such prior steam generators are equipped with a delivery pipe through which a jet of steam is directed against a surface to be cleaned.

On contacting that surface, some of the steam is condensed, and the condensate, enclosing the removed dirt, must then be taken away by conventional means.

As an example, some steam generators are fitted at the free end of the delivery pipe with an outlet fitting provided with either sponges, or brushes, or absorbing materials purposely arranged to take up the condensate.

It has been found, however, that the condensate removal provided by such devices is unsatisfactory in that, once they are soaked with condensate, they require to be freed of it, such as by wringing, by the user him/herself. Further, the dirt which has been removed along with the condensate is spread in part over other areas of the surface being cleaned.

It is for this reason that it has been preferable heretofore to remove the condensate and the dirt enclosed therein on completion of the steam cleaning step, using rags or the like.

Also known are liquid aspirators which may be employed to advantage for taking away the condensate after the steam cleaning step. However, that scheme, albeit efficient, involves the use of two separate appliances which are both expensive and quite bulky.

The problem underlying this invention is to provide an electrical household appliance which can afford optimum steam cleaning capabilities on a variety of surfaces and just as optimum a removal of the condensate and the dirt dissolved through it.

This problem is solved by the invention with the provision of an electrical household appliance for steam cleaning, having a monocoque body and being characterized in that it comprises, in combination within said monocoque body, a steam generator including a boiler and a steam delivery conduit extending from the boiler, and a suction device arranged to draw liquids and including an electrical aspirator and a container for collecting the matter drawn.

The features and advantages of this invention will be more clearly understood from the following detailed description of a preferred embodiment thereof, to be taken by way of illustration and not of limitation in connection with the accompanying drawings, where:

Figure 1:
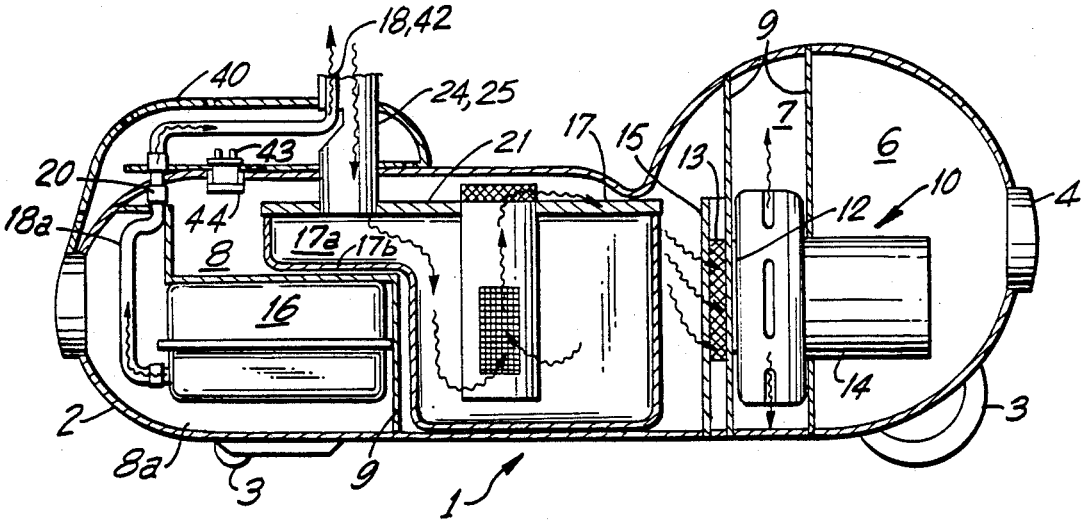
FIG. 1 is a sectional view showing schematically an electrical household appliance according to this invention.

In the drawing views, the numeral 1 designates generally an electrical household appliance according to this invention. The appliance 1 comprises a monocoque body 2 mounted on wheels 3 and being surrounded peripherally by a band bumper 4.

Four compartments, respectively indicated at 6, 7, 8, and 8*a*, are defined inside the body 2 and separated by partitions 9.

The compartments 6 and 7 accommodate an electrical aspirator 10 therein which has a suction mouth 12 provided with a filter 13 and being open into the compartment 8. With the aspirator 10 in operation, air is drawn out of the compartment 8 and ejected through openings formed in the body at the compartment 7.

The electrical aspirator 10 includes a two-speed electric motor located in the compartment 6.

The filter 13, of the cartridge type, fits removably in guides 15 integral with the partition 9 separating the compartments 7 and 8 from each other.

In the compartments 8*a* and 8, there are respectively installed a steam generator 16 and a container 17 for collecting matter drawn up, as explained hereinafter. The steam generator 16 is a type known per se, e.g. including a dip-type electric resistance heater. A steam delivery conduit, indicated at 18, extends therefrom.

The conduit 18 has a first section 18*a* housed within the body 2 and terminated with a male-type quick connector 20 mounted to the body 2.

The container 17, which is preferably a plastics molding, has a cover 21 fitting removably over the container 17. The container 17 has an extended section 17*a* having a surface 17*b* for diverting drawn matter (fluid) matter into the container. A quick connection socket 23 is formed in the cover 21 for a rigid tubular section 24 of an otherwise flexible tubular conduit 25. The conduit 25 is a suction conduit of the appliance 1.

From the cover 21 there extends perpendicularly inwards of the container 17 a cylindrical tubular housing 26 having wall portions 27 fitted with grids, a bottom 28, and a first opening 29 in the cover 21.

A filter 30 is mounted removably on the opening 29.

On an intermediate section of the housing 26, there is mounted a conical diaphragm 31 having a centre opening 32.

Between the bottom 28 and the diaphragm 31, a float 33 is allowed to move which can abut the diaphragm 31 to close the opening 32 when drawn-up matter (fluid) is present in the container 17 which exceeds a preset level, thereby it behaves like a float valve.

A partition 35 stands up on the bottom of the container 17 to delimit an opening 35*a*. A tubular case 37 stands up on the bottom of the container 17, around the tubular housing 26, thereby providing a labyrinth path between the quick connection socket 23 for the suction conduit and the tubular housing 26. The tubular case 37 is apertured as at 38, at a substantially opposed location from the opening 35*a*.

With the electrical aspirator 10 in operation, in vacuum is created within the compartment 8 of the body 2 which results in air being drawn up through the suction conduit 25. Liquids, dirt, dust, and the like matter, referred to herein as the drawn-up fluid, are therefore entrained by the air stream through the suction conduit 25 to the container 17. The path of the intake air is indicated by the arrows A in FIG. 1.

The heaviest matter settles at the bottom of the container 17, whereas the lightest matter is withheld by the grid portions 27 of the tubular housing 26. The intake air is first filtered by the filter 30 and then by the filter 13.

Figure 2:
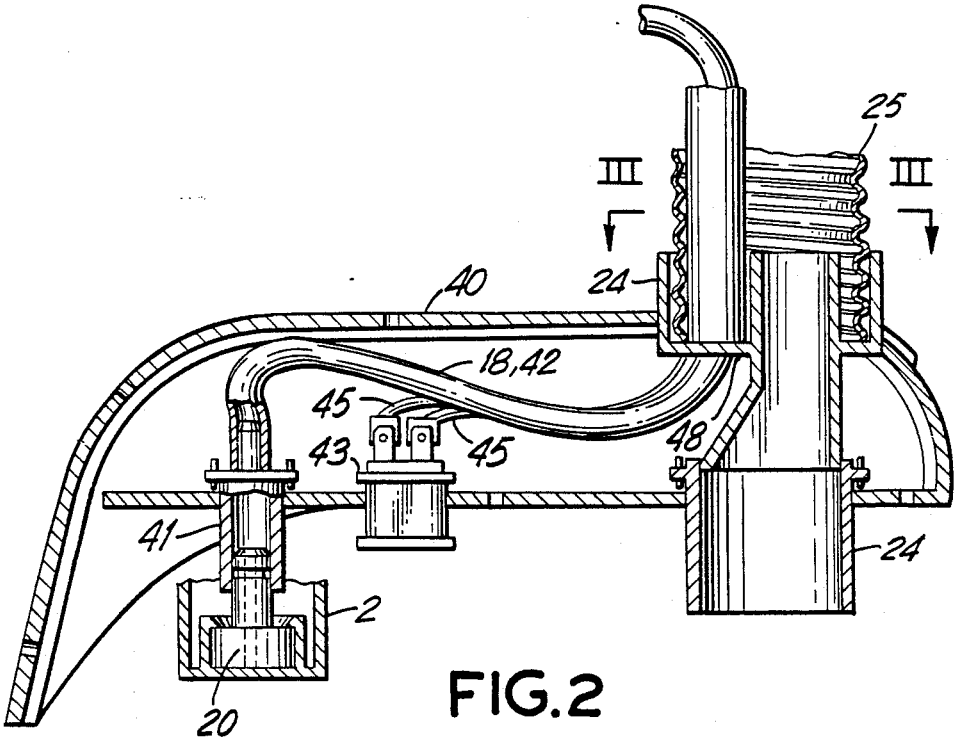
FIG. 2 is a sectional detail view of the appliance shown in FIG. 1.
Figure 3:
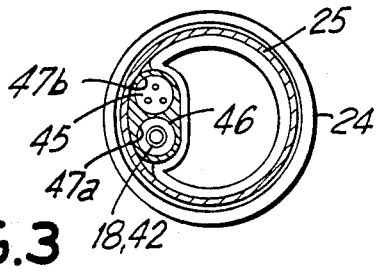
FIG. 3 is a sectional view taken along the line III—III in FIG. 2.
Figure 4:
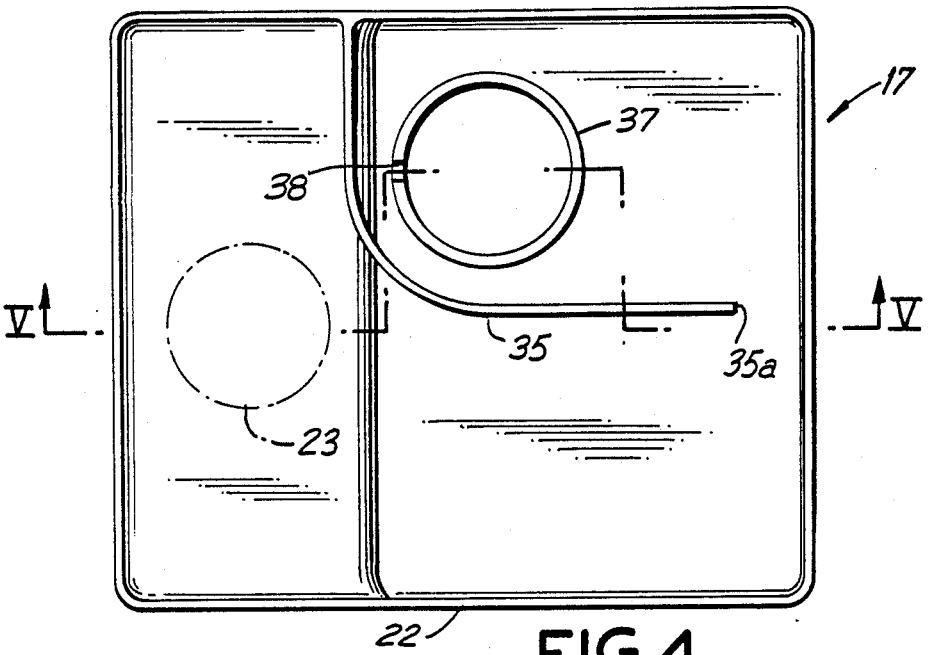
FIG. 4 is a top plan view of a tray for collecting the matter drawn up, provided in the appliance of FIG. 1 (without cover)
Figure 5:
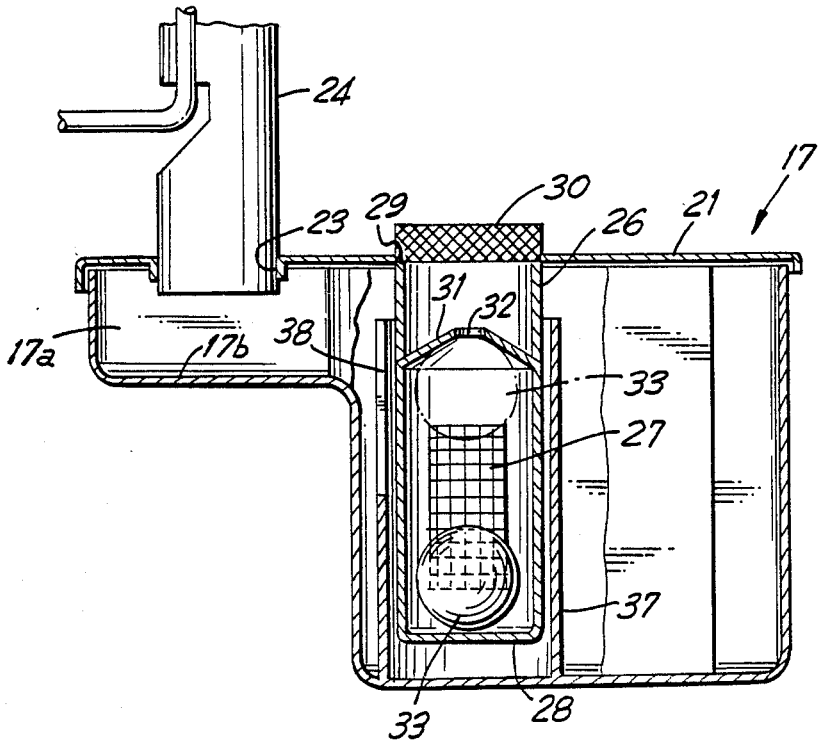
FIG. 5 is a sectional view through the tray, taken along the line V—V in FIG. 4.

FIGS. 2 and 3 show a base member, generally indicated at 40, on which there are mounted the rigid tubular fitting section 24 of the conduit 25, a female connector 41 whence a second section 42 of the steam delivery conduit 18 extends, and an electrical connector 43 adapted to be engaged, by a male-to-female type of connection, with a corresponding electrical connector 44 attached to the body 2.

The electrical connectors 43, 44 are intended for connecting electrically via cables, not shown in FIG. 1 and indicated schematically at 45 in FIGS. 2 and 3, a control unit located, for example, within a handgrip, not shown, mounted to the flexible suction conduit 25, from the electrical fan 10 and the steam generator 16 to drive them from a remote station.

The base 40 is mounted removably on the body 2 so as to engage, by a single operation, the connectors 20, 41 of the steam delivery conduit 18 and the electrical connectors 43, 44, and fit the tubular section 24 of the suction conduit 25 tightly to the container 17.

The second section 42 of the steam delivery conduit 18 of the cables 45 are run through the suction conduit 25 inside an insulating sleeve 46 formed with two respective seats 47*a,b* and caused to adhere on the inner wall of said conduit 25.

In the rigid tubular section 24 there is formed, at the sleeve 46, a cutout 48 through which said cables 45 and second section 42 of the conduit 18 exit the suction conduit 25 to join their respective connectors.

The suction conduit 25 and the steam delivery conduit 18 are led to a common suction/delivery header, not shown because it forms no part of this invention.

To clean surfaces by the electrical household appliance 1, the following procedure applies:

In the first place, one can remove dust and dirt that do not adhere closely to the surface to be cleaned by just operating the electrical aspirator 10 and using the appliance 1 as an ordinary vacuum cleaner. On completion of this step, the electrical fan 10 is deactivated and the steam generator 16 is activated instead to discharge steam against the surface being cleaned.

By virtue of the cleaning and degreasing ability of steam, dirt adhering on the surface is detached and dissolved and enclosed in the condensate.

Then, the steam generator is deactivated and the electrical aspirator 10 re-activated to remove by suction the condensate left on the surface being cleaned.

The condensate, as well as the dust previously removed, collect inside the container 17. The air used to draw up the condensate and dust is filtered through the filters 30 and 13, and then returned to the ambience. The container 17, once filled up, is removed from the body 2, emptied, and cleaned.

The main advantage afforded by this electrical household appliance is that it may be operated as a conventional dust and liquid drawing appliance, as well as an appliance for steam cleaning and then taking the condensate away from the cleaned surfaces.

I claim:

1. An electrical household appliance for steam cleaning having a monocoque body comprising;

a steam generator in said body including a boiler and a steam delivery conduit extending from the boiler;

an electrical aspirator in said body for drawing fluid and matter suspended therein;

a container in said body for collecting matter from said drawn fluid in communication with said aspirator; and a tubular suction conduit extending from said container, and comprising a sleeve associated with an inner wall of said suction conduit, wherein a portion of said steam delivery conduit extending from said steam generator lies within said sleeve, said electrical aspirator drawing fluids and suspended matter through said suction conduit.

2. The electrical appliance in accordance with claim 1, wherein said container is removable from said body, said container comprising;

a removable cover having a first opening through which said electrical aspirator draws fluid; and a float valve for shutting off said opening when a set level of fluid is drawn into said container.

3. The electrical appliance in accordance with claim 2, wherein said cover further comprises a connector socket for connecting said suction conduit to said container and a filtering means lying within said first opening.

4. The electrical appliance in accordance with claim 3, wherein said fluid follows a labyrinth path between said socket and said first opening in the cover of said container.

5. The electrical appliance in accordance with claim 4, further comprising a base removably connected to said monocoque body, wherein said steam delivery conduit comprises;

first and second sections, said first section leading from said boiler to a surface of said monocoque body, and said second section leading from said monocoque body to a surface of said base; a first connector for connecting said first and second sections to the surface of the body; and a second connector for connecting said second section to the surface of the base.

6. The electrical appliance as in claim 4 wherein said container has an extended section where said suction conduit enters said container, said extended section having a surface for diverting said drawn fluid further into said container, along said labyrinth path.

7. The electrical appliance in accordance with claim 6, wherein said container further comprises;

a tubular case extending from a bottom of the container, part of the distance to the top of the container, having an open top;

a cylindrical tubular housing, extending from said first opening of said cover, part of the distance to the bottom of the container, lying within said tubular case, and a filtering means along the surface of said tubular housing, said float valve lying within said tubular housing;

wherein the height of said tubular case is above the bottom of said extended section, such that said diverted fluid travels along said labyrinth path, up and over the tubular case and down between said tubular case and said tubular housing, through said filtering means, up through said tubular housing, such that heavier matter settles on said bottom on said container and lighter matter is trapped within said filtering means.

8. An electrical appliance in accordance with claims 1 or 7, wherein said sleeve is insulated.

9. An electrical appliance in accordance with claim 8, further comprising electrical cables extending from said body, lying within said sleeve.

* * * * *